US008727908B2

(12) United States Patent
Goto

(10) Patent No.: US 8,727,908 B2
(45) Date of Patent: May 20, 2014

(54) GOLF CLUB HEAD

(75) Inventor: Masato Goto, Kobe (JP)

(73) Assignee: Dunlop Sports Co. Ltd., Kobe (JP)

( * ) Notice: Subject to any disclaimer, the term of this patent is extended or adjusted under 35 U.S.C. 154(b) by 110 days.

(21) Appl. No.: 13/559,646

(22) Filed: Jul. 27, 2012

(65) Prior Publication Data

US 2013/0029782 A1 Jan. 31, 2013

(30) Foreign Application Priority Data

Jul. 29, 2011 (JP) ..... 2011-166448

(51) Int. Cl.
*A63B 53/04* (2006.01)

(52) U.S. Cl.
CPC ..... *A63B 53/04* (2013.01); *A63B 2053/0462* (2013.01); *A63B 2053/0416* (2013.01); *A63B 2053/0458* (2013.01)
USPC ..... 473/329; 473/342

(58) Field of Classification Search
CPC ..... A63B 53/04; A63B 2053/0458; A63B 2053/0462; A63B 2053/0416; A63B 2053/0445
USPC ..... 473/329, 342
See application file for complete search history.

(56) References Cited

U.S. PATENT DOCUMENTS 4,252,262 A * 2/1981 Igarashi ..... 228/174
5,354,059 A * 10/1994 Stuff ..... 473/329
5,505,450 A * 4/1996 Stuff ..... 473/329
6,193,615 B1 * 2/2001 Hirota ..... 473/329
6,428,425 B1 * 8/2002 Naruo et al. ..... 473/329
6,800,038 B2 * 10/2004 Willett et al. ..... 473/329
7,137,907 B2 * 11/2006 Gibbs et al. ..... 473/329
7,448,961 B2 * 11/2008 Lin ..... 473/332
7,578,755 B2 * 8/2009 Oyama ..... 473/342
7,594,862 B2 * 9/2009 Gilbert ..... 473/330
7,762,907 B2 * 7/2010 Rice ..... 473/329
7,909,708 B2 * 3/2011 Gilbert ..... 473/330
8,083,605 B2 * 12/2011 Franklin et al. ..... 473/251
8,267,807 B2 * 9/2012 Takechi et al. ..... 473/332
8,414,419 B2 * 4/2013 Curtis et al. ..... 473/329
8,500,572 B2 * 8/2013 Curtis et al. ..... 473/329
8,535,177 B1 * 9/2013 Wahl et al. ..... 473/350
8,574,095 B2 * 11/2013 Hirano ..... 473/329
2003/0064823 A1 * 4/2003 Yamamoto ..... 473/329
2005/0272524 A1 * 12/2005 Oh ..... 473/329
2007/0225086 A1 * 9/2007 Lin ..... 473/342
2011/0224016 A1 * 9/2011 Gilbert ..... 473/331
2013/0303305 A1 * 11/2013 Myrhum et al. ..... 473/342

FOREIGN PATENT DOCUMENTS

JP 2002-165905 A 6/2002
JP 2002-253709 A 9/2002
JP 2003-275343 A 9/2003
JP 2004-187795 A 7/2004

* cited by examiner

*Primary Examiner* — William Pierce
(74) *Attorney, Agent, or Firm* — Birch, Stewart, Kolasch & Birch, LLP

(57) ABSTRACT

A golf club head with a hollow comprises a face portion whose front face defines a clubface for hitting a ball, the face portion comprising a central thicker portion provided in a center region thereof and a peripheral thinner portion provided around the central thicker portion and with a thickness smaller than that of the central thicker portion, the inner surface of the peripheral thinner portion comprising a first region and a second region, the first region being provided with a plurality of first grooves which extend straightly in a certain direction, and the second region being provided with a plurality of second grooves which extend straightly in the different direction of first grooves.

9 Claims, 8 Drawing Sheets

PRIOR ART

GOLF CLUB HEAD

BACKGROUND OF THE INVENTION

1. Field of the Invention

The present invention relates to a golf club head in which a spring effect and a productivity of a clubface can be improved in a well-balanced manner.

2. Description of the Related Art

Recent years, it has been proposed a hollow golf club head with a face portion which has an inner surface being provided grooves thereon in order to improve a spring effect of the face portion. Since such a golf club head has a small rigidity and flexibility of the face portion, a large flexure of the face portion when hitting a ball can be produced.

For example, as shown in FIG. 9, JP2002-253709A1 proposes a golf club head (a) which has a face portion (b) with an inner surface (ba) being provided circular grooves c1. Since the face portion (b) of the golf club head (a) has flexibility, it has an improved spring effect. However, each circular groove c1 provided on the inner surface (ba) of the face portion (b) described above comprises a plurality of arcs with the different radius of curvatures. Therefore, it is difficult to process these circular grooves on the inner surface of the face portion.

It is an object of the present invention to provide a golf club head in which a spring effect and a productivity of a clubface can be improved in a well-balanced manner.

SUMMARY OF THE INVENTION

In accordance with the present invention, there is provided a golf club head comprising a face portion whose front face defines a clubface for hitting a ball, the face portion comprising a central thicker portion provided in a center region of the face portion and a peripheral thinner portion provided around the central thicker portion and having a thickness smaller than that of the central thicker portion, the peripheral thinner portion having an inner surface facing the hollow, the inner surface of the peripheral thinner portion comprising a first region and a second region, the first region being provided with a plurality of first grooves which extend straightly in a certain direction, and the second region being provided with a plurality of second grooves which extend straightly in the different direction of first grooves.

DETAILED DESCRIPTION

An embodiment of the present invention will be explained below with reference to the accompanying drawings.

Figure 1:
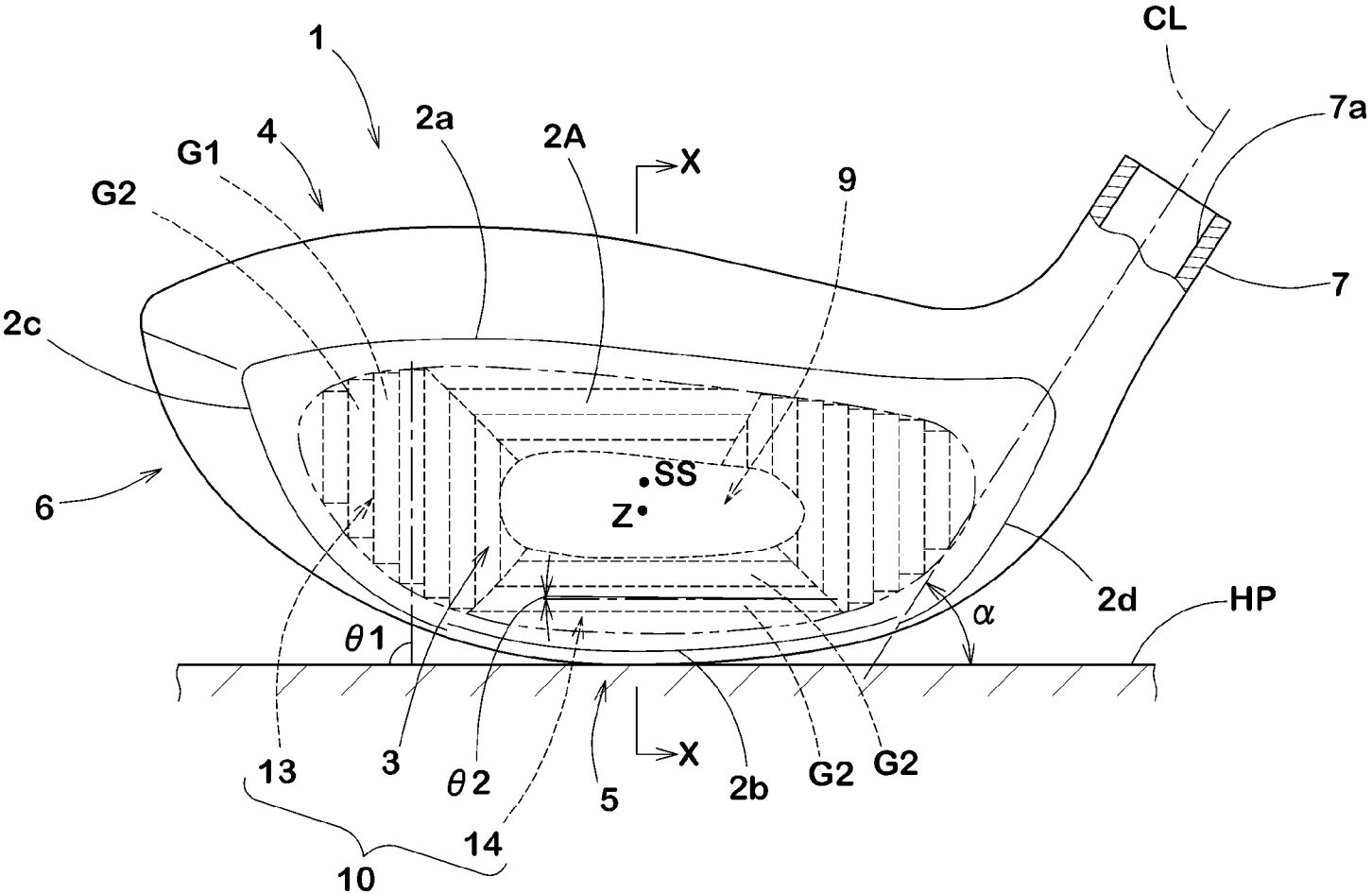
FIG. 1 is a front view of a golf club head under a standard state showing an embodiment of the present invention.
Figure 2:
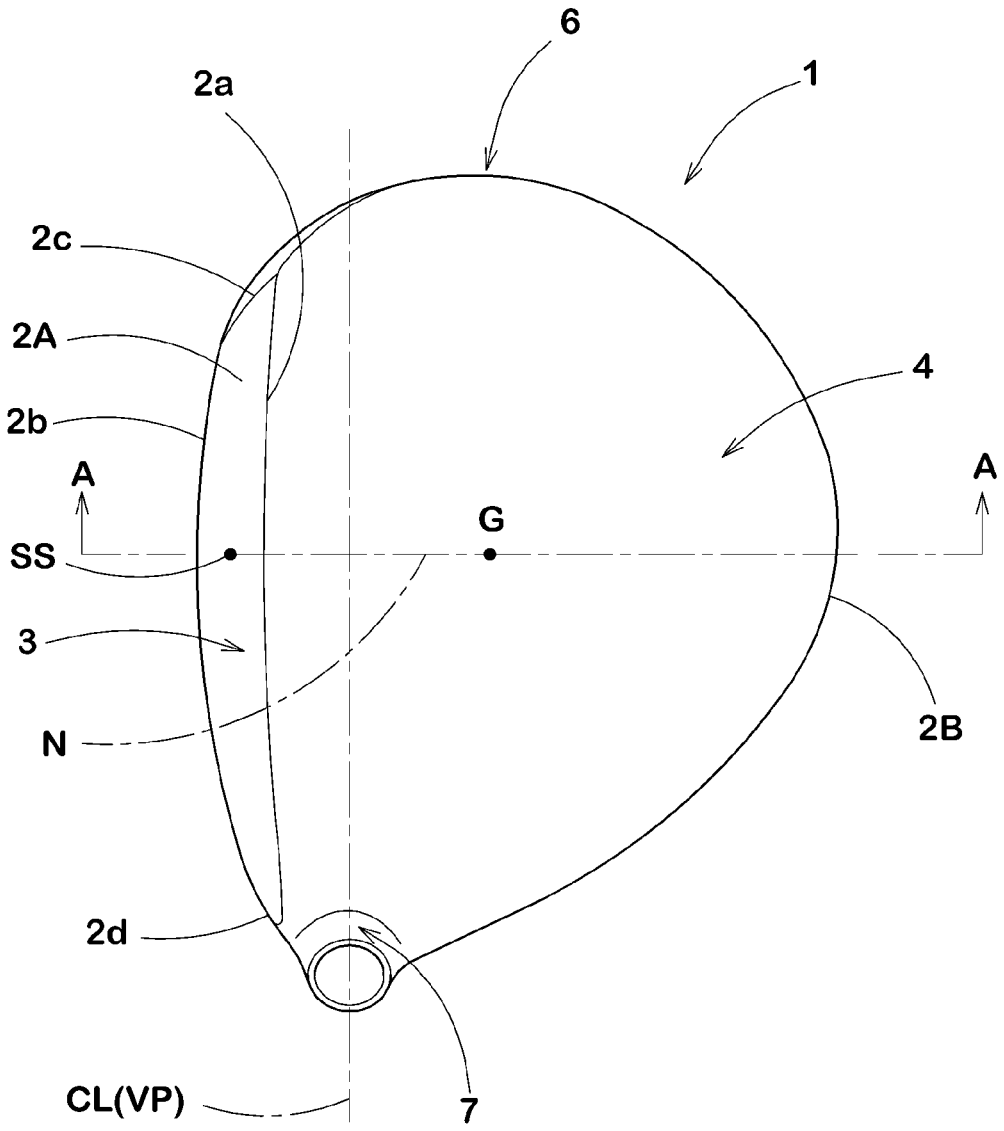
FIG. 2 is a plan view of the club head of FIG. 1.
Figure 3:
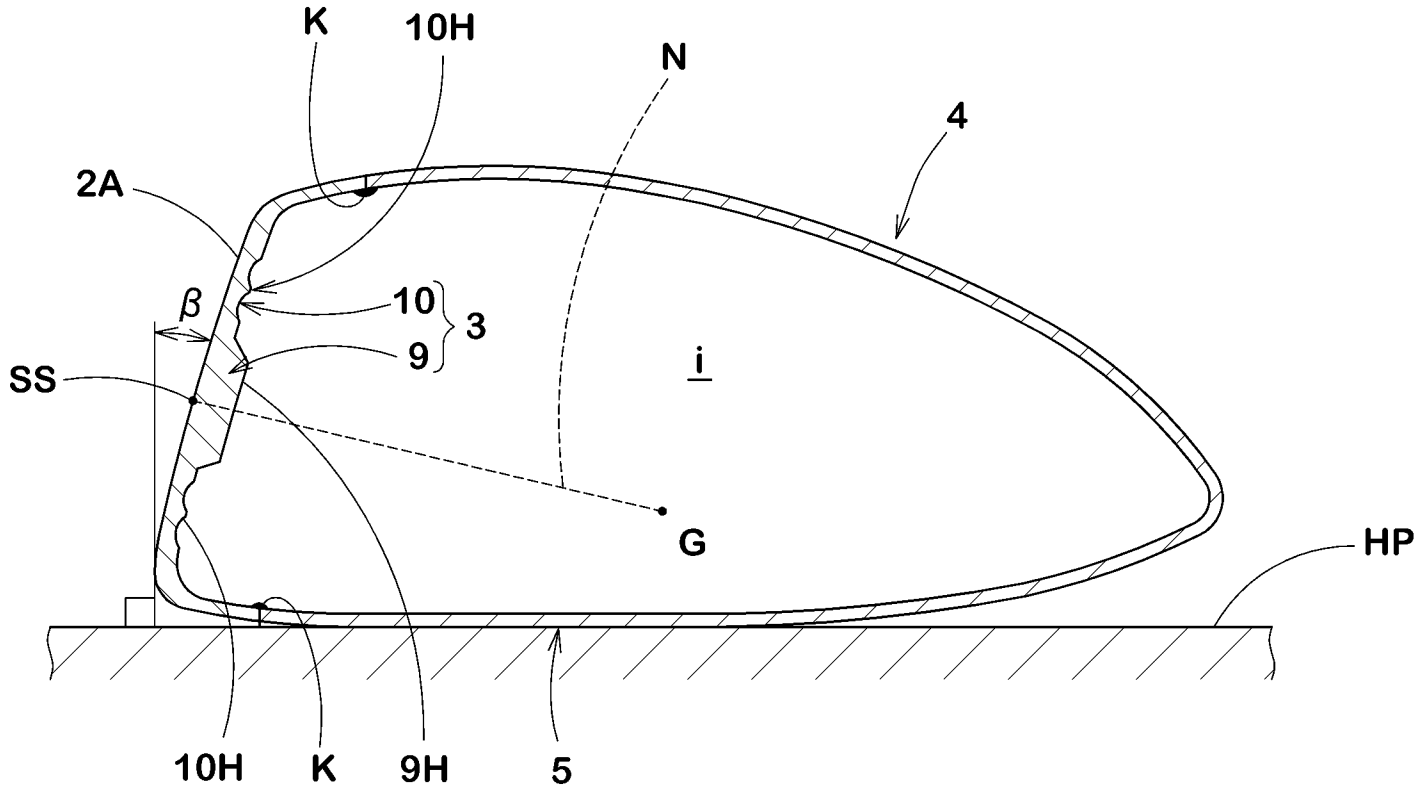
FIG. 3 is a cross sectional view taken along the line A-A of FIG. 2.

FIGS. 1 to 3 each shows golf club head (hereinafter referred simply as "head" or "club head") 1 under a standard state according to an embodiment of the present invention.

Here, the standard state is a state that the club head 1 is placed on a horizontal plane HP, so that a clubshaft center line CL inclines at its lie angle $\alpha$ within a vertical plane VP, and a clubface 2A inclines at its loft angle $\beta$ with respect to the vertical plane VP. The club head 1 referred to herein is in the standard state unless otherwise noted.

In the standard state, the face angle of the clubface 2A is set at zero degree. Also, the loft angle $\beta$ is defined more than 0 degree, and is defined as an angle of a tangent line passing through a sweet spot SS of the clubface 2A with respect to the vertical plane VP.

The sweet spot SS is the point of intersection between the clubface 2A and a straight line N drawn normally to the clubface 2A passing the center of gravity G of the head 1.

The club head 1 includes a face portion 3 whose front face defines the clubface 2A for hitting a golf ball, a crown portion 4 extending from an upper edge 2*a* of the clubface 2A to form the upper surface of the head 1, a sole portion 5 extending from lower edge 2*b* of the clubface 2A to form the bottom surface of the head 1, a side portion 6 which extends between the crown portion 4 and the sole portion 5 from a toe side edge 2*c* of the clubface 2A to a heel side edge 2*d* of the clubface 2A through a back face BF of the head 1, and a hosel portion 7 which is disposed on a heel side of the crown portion 4 and has a shaft inserting hole 7*a* to attach the clubshaft (not shown). In case that no shaft is attached to the club head 1, an axial center line CL of the shaft inserting hole 7*a* is used instead of an axial center line of the clubshaft.

The club head 1 is preferably formed into a wood-type club head with a hollow structure that a hollow portion "i" is formed inside the club head 1. The term "wood-type golf club head" means golf club heads having a so-called wood-type head shape, e.g., driver (#1 wood), brassy (#2 wood), spoon (#3 wood), baffy (#4 wood) and cleek (#5 wood), and comprehends heads which are different from these heads in number or name, but have a shape approximately similar to these heads.

Although it is not especially limited, the club head 1 preferably has a head volume of at least 100 $cm^3$, more preferably at least 130 $cm^3$. If the volume of the club head 1 is too small, problems may arise, e.g., decreasing the moment of inertia around the vertical axis passing through the center of gravity of the club head 1, or decreasing the depth of the center of gravity of the club head 1. These may cause deterioration of directional stability in hit balls. On the other hand, if the volume of the club head 1 is too large, problems may arise, e.g., increase of head weight, deterioration of swing balance and violation of golf rules. Therefore, it is preferable that the volume of club head 1 is preferably at most 470 $cm^3$, especially at most 460 $cm^3$.

Figure 4:
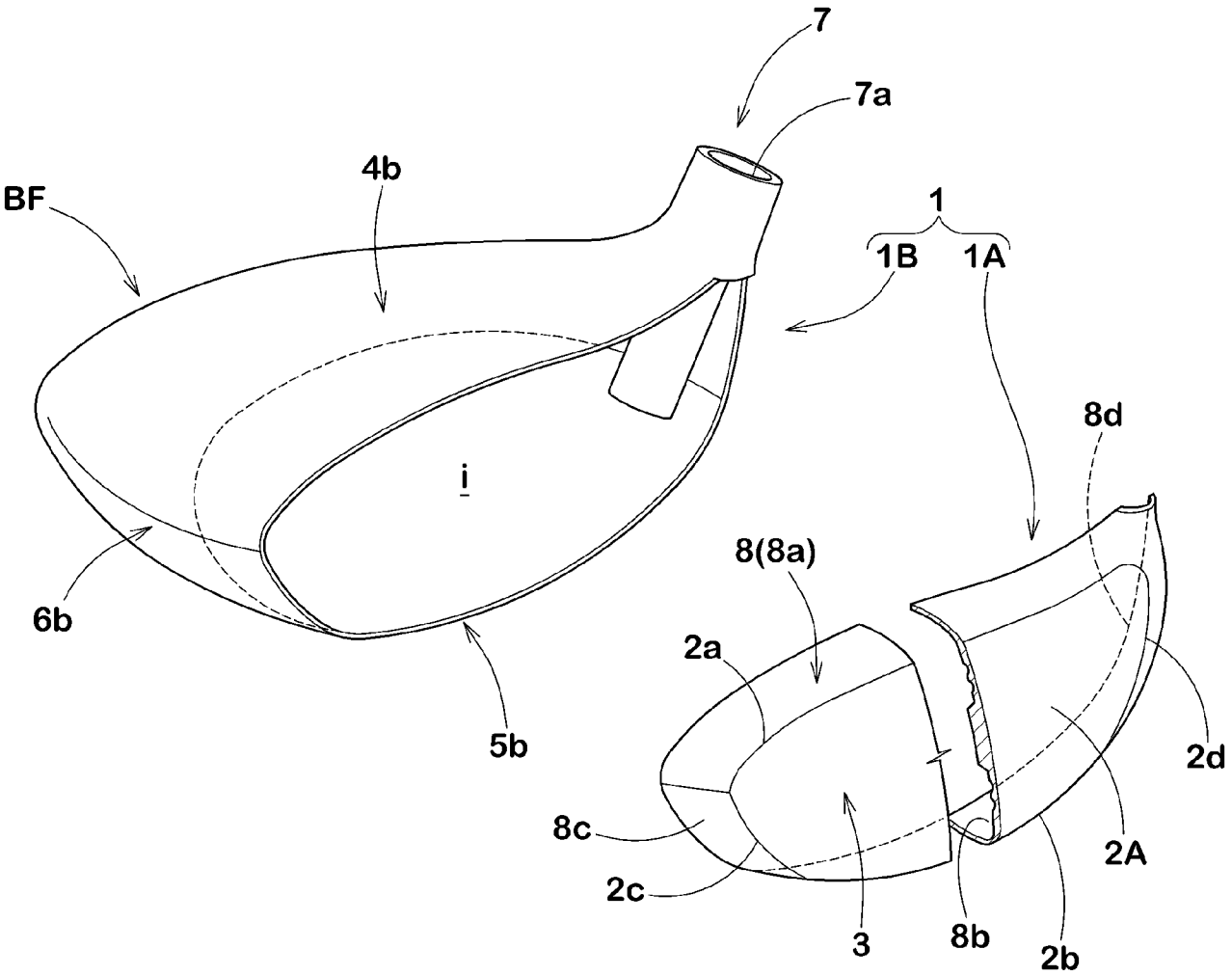
FIG. 4 is an exploded view of the club head of FIG. 1.

As shown in FIG. 4, the club head 1 in this embodiment has a two-piece structure comprising a face member 1A including the face portion 3 and a head main body 1A. The face member 1A is attached on the front side of the head main body 1B. However, as for the structure of the club head 1, three-piece or four-piece structures may be employed. The head body 1B and the face member 1A are produced from one or more kinds of metallic materials. Preferable examples of the metallic materials are, for instance, a stainless steel, a titanium alloy, and combinations of these metals. Further, although not shown in the drawings, non-metallic materials with a lower specific gravity such as fiber-reinforced resins may be used in a part of the head main body 1B.

The face member 1A in this embodiment is formed into an approximately cup-shaped body in which the whole face portion 3 and an extension part 8 are included. The extension part 8 comprises a crown-side extension part 8*a*, a sole-side extension part 8*b*, a toe-side extension part 8*c* and a heel-side extension part 8*d* which extend toward the rear of the club head 1 from the edges 2*a*, 2*b*, 2*c* and 2*d* of the clubface 2A to provide respective front portion of the crown portion 4, sole portion 5 and side portion 6. In this embodiment, the face member 1A is produced as one piece by pressing a steel plate so as to plastically deform, for example. In such a face member 1A, welding between the face member 1A and the head main body 1B can be done on smooth surfaces of the crown portion 4, the sole portion 5 and the side portion 6. Therefore, productivity of welding of the golf club head may be improved according to the present embodiment. In FIG. 3, the welding bead K between the face member 1A and the head main body 1B which remains in the hollow is shown.

The head main body in this embodiment 1B integrally includes a crown rear section 4*b*, a sole rear section 5*b* and a side rear section 6*b* which comprise each major part of the crown portion 4, sole portion 5, and the side portion 6. The head main body 1B also integrally includes the hosel portion 7. Namely, the head main body 1B is composed of a remained part excluding the face member 1A from the club head 1. The head main body 1B can be produced by a known method, e.g., casting.

Figure 5:
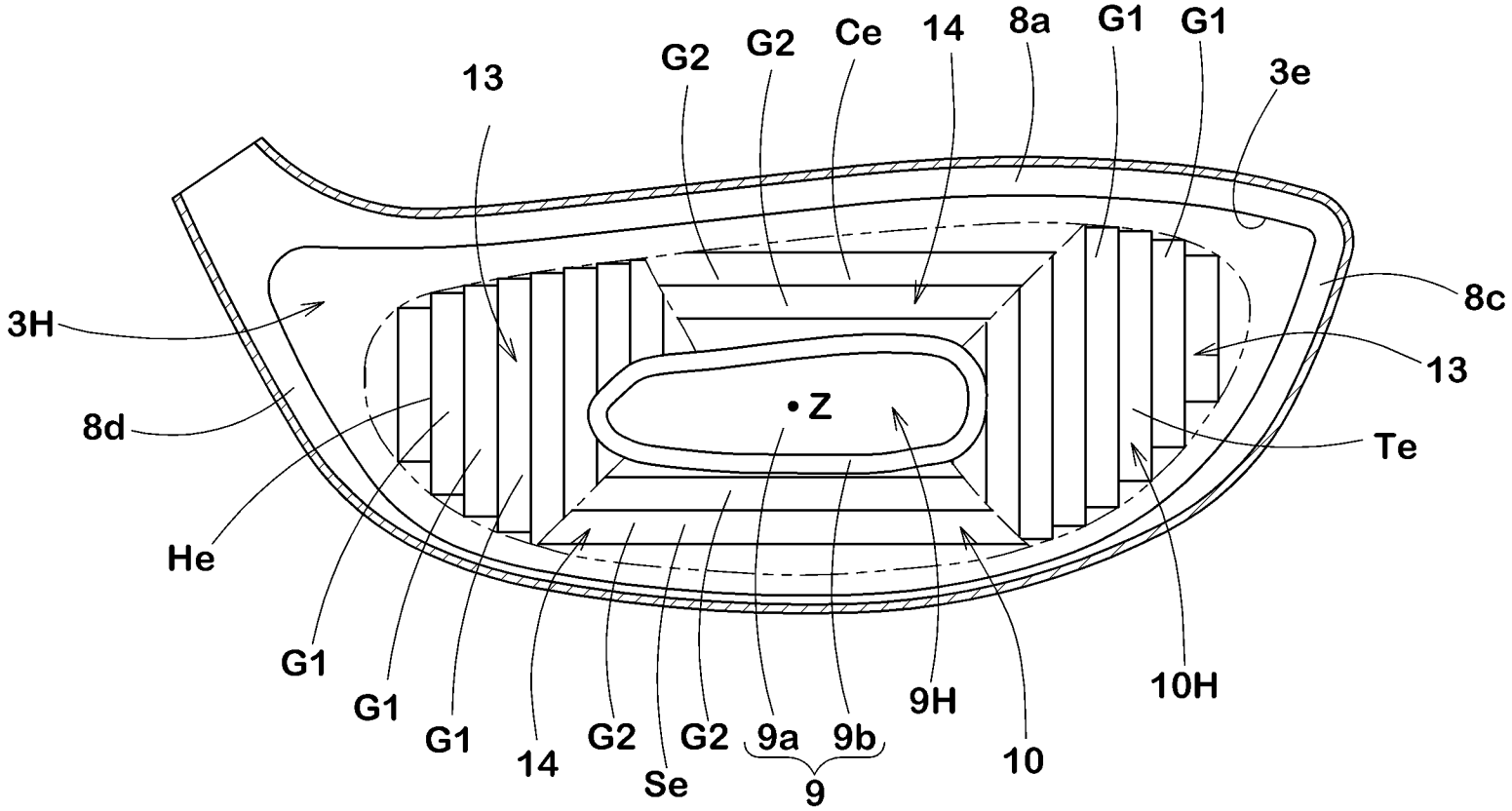
FIG. 5 is a rear view of a face portion of the club head.

As shown in FIGS. 1 and 5, the face portion 3 comprises a central thicker portion 9 provided in a center region of the face portion 3 and a peripheral thinner portion 10 provided around the central thicker portion 9 and has a thickness smaller than that of the central thicker portion 9.

Figure 6:
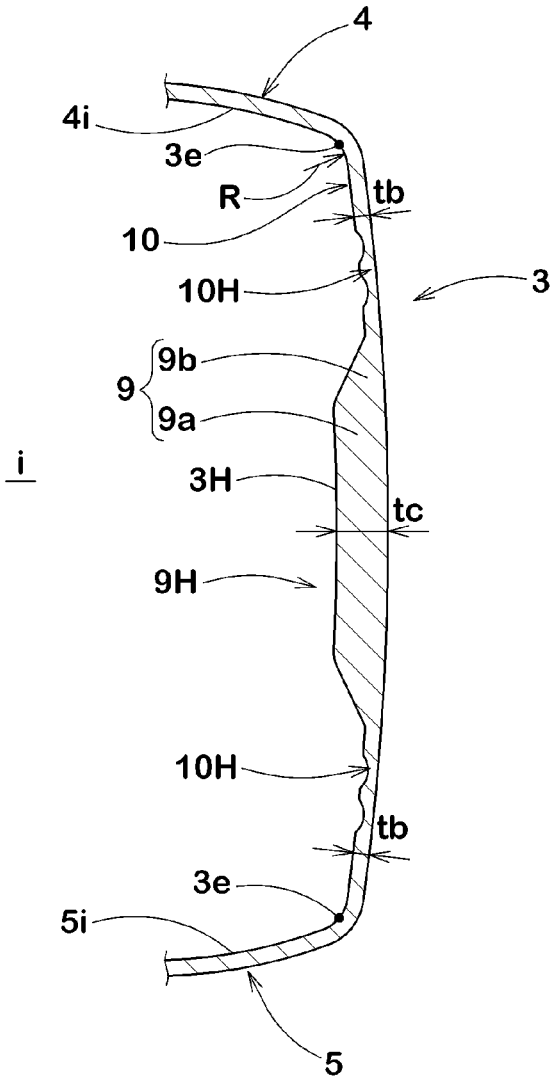
FIG. 6 is a cross sectional view taken along the line X-X of FIG. 1.

The center region of the face portion 3 is given a big impact force when hitting a ball. Therefore, by providing the central thicker portion 9 with the center region of the face portion 3, the durability of the face portion 3 can be improved. Here, the center region of the face portion 3 is a certain region at least including the centroid Z of a shape surrounded by a contour edge 3*e* of the inner surface 3H of the face portion 3. Also, the center region does not reach the contour edge 3*e* of the inner surface 3H of the face portion 3. The inner surface 3H of the face portion 3 means a surface facing to the hollow i. As shown in FIG. 6, the contour edge 3*e* of the inner surface 3H of the face portion 3 means a boundary between the inner surface 3H of the face portion 3 and inner surfaces of each of the crown portion 4, sole portion 5 and the side portion 6. In FIG. 6, the inner surface 4*i* of the crown portion 4 and the inner surface 5*i* of the sole portion 5 are illustrated. When the boundary is unclear by being connected between the two inner surfaces using a chamfer portion in order to reduce a stress concentration, the contour edge 3*e* shall be defined as the center point of the length of an arc R of the chamfer in each cross section of the club head 1 as shown in FIG. 6.

In this embodiment, the central thicker portion 9 comprises a main portion 9*a* which includes the centroid Z with a constant thickness tc, and a transition portion 9*b* which surrounds the main portion 9*a* with a thickness gradually decreasing so as to form a slant surface toward the peripheral thinner portion 10.

The main portion 9*a* has the thickness tc which is the maximum thickness in the face portion 3. Also, in order to maintain both the durability of the face portion 3 and the ability of spreading the flexure toward the peripheral thinner portion 10, the main portion 9*a* has a contour of an oval like shape whose long diameter is taken along the toe-heel direction of the club head 1.

In order to maintain both the durability of the face portion 3 and a suitable weight of the club head 1 in a well-balance, the thickness tc of the main portion 9*a* is preferably set not less than 1.8 mm, and more preferably not less than 2.2 mm. Also, the thickness tc of the main portion 9*a* is preferably set not more than 4.5 mm, and more preferably not more than 4.0 mm. In such a view described above, the area S1 of the inner surface 9H of the central thicker portion 9 is preferably set at least 10%, more preferably at least 15%, of the whole area S of the inner surface 3H of the face portion 3. Also, the area S1 of the inner surface 9H of the central thicker portion 9 is preferably set at most 40%, more preferably at most 30%, of the whole area S of the inner surface 3H of the face portion 3. Here, each area S1 and S2 shall be defined as an area that the inner surfaces 9H or 3H is projected onto the vertical plane VP. Although it is not particular limited, the whole area S of the inner surface 3H of the face portion 3 is preferably set at least 15 $cm^2$, more preferably at least 17 $cm^2$, and preferably at most 50 $cm^2$, more preferably at most 48 $cm^2$.

As shown in FIG. 6, the peripheral thinner portion 10 has the thickness tb smaller than the thickness tc of the central thicker portion 9. The peripheral thinner portion 10 makes it possible to improve the spring effect of the face portion 3 by increasing the flexibility of the face portion when hitting a ball.

Thus, the thickness tb (shown in FIG. 6) of the peripheral thinner portion 10 is preferably set at least 1.4 mm, more preferably at least 1.6 mm, and preferably at most 3.0 mm, more preferably 2.8 mm. If the thickness tb is too small, there may be a tendency that the durability of the face portion 3 is deteriorate. On the other hand, if the thickness tb is too large, the spring effect tends to be decreased. Here, the thickness tc of the central thicker portion 9 and the thickness tb of the peripheral portion 10 shall be measured in a state that whole grooves and/or whole impact area markings such as score lines provided on the face portion 3 are being filled.

As shown in FIGS. 1 and 5, the inner surface 10H of the peripheral thinner portion 10 comprises the first region 13 and the second region 14. The first region 13 is provided with a plurality of first grooves G1 which extend straightly in a certain direction. The second region 14 is provided with a plurality of second grooves G2 which extend straightly in the different direction of first grooves G1. These straightly extending first grooves G1 and second grooves G2 are easily processed compared to continuously circular grooves. Moreover, since first grooves G1 and second grooves G2 each extend the different direction on the inner surface 10H of the peripheral portion 10, the face portion 3 may be greatly bent compared to the straight grooves extending one certain direction. Therefore, the club head 1 according to the present invention can improve both the spring effect and productivity of the face portion 3.

In this embodiment, first grooves G1 extend in parallel with each other. Second grooves G2 also extend in parallel with each other. It is desirable that first grooves G1 extend at right angles to the second groove G2. With this, since the peripheral thinner portion 10 can be widely bent, the spring effect of the face portion 3 is further improved.

In this embodiment, each first groove G1 inclines at angle θ1 of from 80 to 100 degrees with respect to the horizontal plane HP in a front view of the club head 1 under the standard state. Moreover, each second groove G2 inclines at angle θ2 of from 0 to 10 degrees with respect to the horizontal plane HP in a front view of the club head 1 under the standard state. With this, since the flexure of the face portion 3 when hitting a ball can spread toward the contour edge 3*e* of the inner surface of the face portion 3 from the hitting point in a well-balance, the spring effect is further improved. If the angle θ1 of first grooves G1 with respect to the horizontal plane HP is too small, the flexure of the face portion 3 tends to not sufficiently spread toward the toe and the heel sides of the face portion 3. From this point of view, the angle θ1 is preferably set in a range of from 85 to 95 degrees. Moreover, if the angle θ2 of second grooves G2 with respect to the horizontal plane HP is too large, the flexure of the face portion 3 tends to not sufficiently spread toward the crown and the sole sides of the face portion 3. From this point of view, the angle θ2 is preferably not more than 5 degrees.

As shown in FIG. 5, first grooves G1 are preferably provided with a toe side region (Te) and a heel side region (He) of the inner surface 10H of the peripheral thinner portion 10. Second grooves G2 are preferably provided with a crown side region (Ce) and a sole side region (Se) of the inner surface 10H of the peripheral thinner portion 10. Namely, the toe side region (Te) and the heel side region (Te) each comprises as the first region 13, and the crown side region (Ce) and the sole side region (Se) each comprises as the second region 14, respectively. With this embodiment, as the flexure of the face portion 3 when hitting a ball is further spread and widely dispersed, the spring effect can be further improved.

Here, the toe side region (Te) is a region which exists toward the toe side than the sweet spot SS and includes the first groove G1 being located in most toe side. The heel side region (He) is a region which exists toward the heel side than the sweet spot SS and includes the first groove G1 being located in most heel side. The crown side region (Ce) is a region which exists toward the crown side than the sweet spot SS between the toe side region (Te) and the heel side region (He). The sole side region (Se) is a region which exists toward the sole side than the sweet spot SS between the toe side region (Te) and the heel side region (He).

Figure 7:
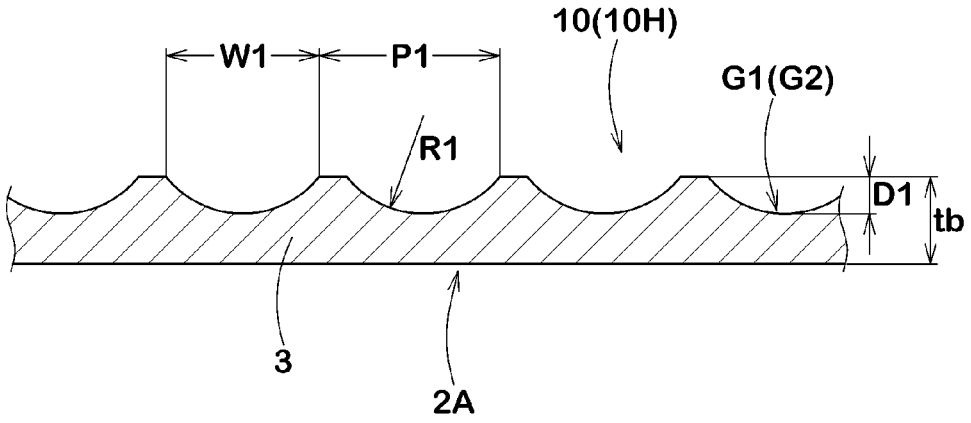
FIG. 7 is a cross sectional view of a peripheral thinner portion in a cross section intersecting with the longitudinal direction of first grooves.

FIG. 7 shows a cross sectional view of the peripheral thinner portion 10 in a cross section intersecting with the longitudinal direction of the groove G1. Each first groove G1 preferably has a groove depth D1 in a range of from 0.02 to 0.80 mm and a groove width W1 in a range of from 0.1 to 3.0 mm. If the groove depth D1 is too large, the durability of the face portion 3 tends to deteriorate. On the other hand, if the groove depth D1 is too small, the spring effect tends to be not sufficiently improved. From this point of view, the groove depth D1 is preferably set not less than 0.05 mm, and preferably not more than 0.50 mm. If the groove width W1 is too large, or too small, the productivity of first grooves tends to deteriorate. From this point of view, the groove width W1 is preferably set not less than 0.3 mm, and preferably not more than 2.0 mm. These suitable groove depth D1 and width W1 of the first grooves may be employed as the suitable depth and width of second grooves, respectively.

Moreover, each first groove G1 preferably has an arc shape in a cross section intersecting with the longitudinal direction of the groove as shown in FIG. 7. With this, the durability of the face portion 3 and its productivity can be improved. In this embodiment, each second groove G2 also has the same cross section of the first groove G1 shown in FIG. 7.

In each first and second grooves G1 and G2, the arc shape preferably has a radius of curvature R1 of from 1.0 to 5.0 mm. With this, the durability of the face portion 3 can be improved by restraining the stress concentration at the groove bottom of the first and second grooves G1 and G2. If the radius R1 of curvature is too large, the spring effect tends to be not sufficiently improved since the groove depth D1 may become small. On the other hand, if the radius R1 of curvature is too small, the productivity of first or second grooves tends to deteriorate since processing such grooves may become difficult. From this point of view, the radius R1 of curvature is preferably set not less than 1.5 mm, and preferably not more than 4.0 mm.

Each pitch P1 between adjacent first grooves is preferably set at least 1.0 times, more preferably at least 1.1 times of groove widths D1 of first grooves G1. Moreover, the pitch P1 is preferably set at most 1.5 times, more preferably at most 1.4 times of groove widths D1. With this, both the spring effect of the face portion 3 and the productivity of first grooves can be improved. With respect to each pitch P1 between adjacent second grooves, the same condition of first grooves G1 may be employed.

First grooves G1 and second grooves G2 can be provided by a known method, e.g., machining using a numerically controlled (NC) machine tool, forging or pressing using a die, or casting. Especially, machining using a NC machine tool with an end mill for processing grooves is preferably employed to process first and second grooves.

Figure 8:
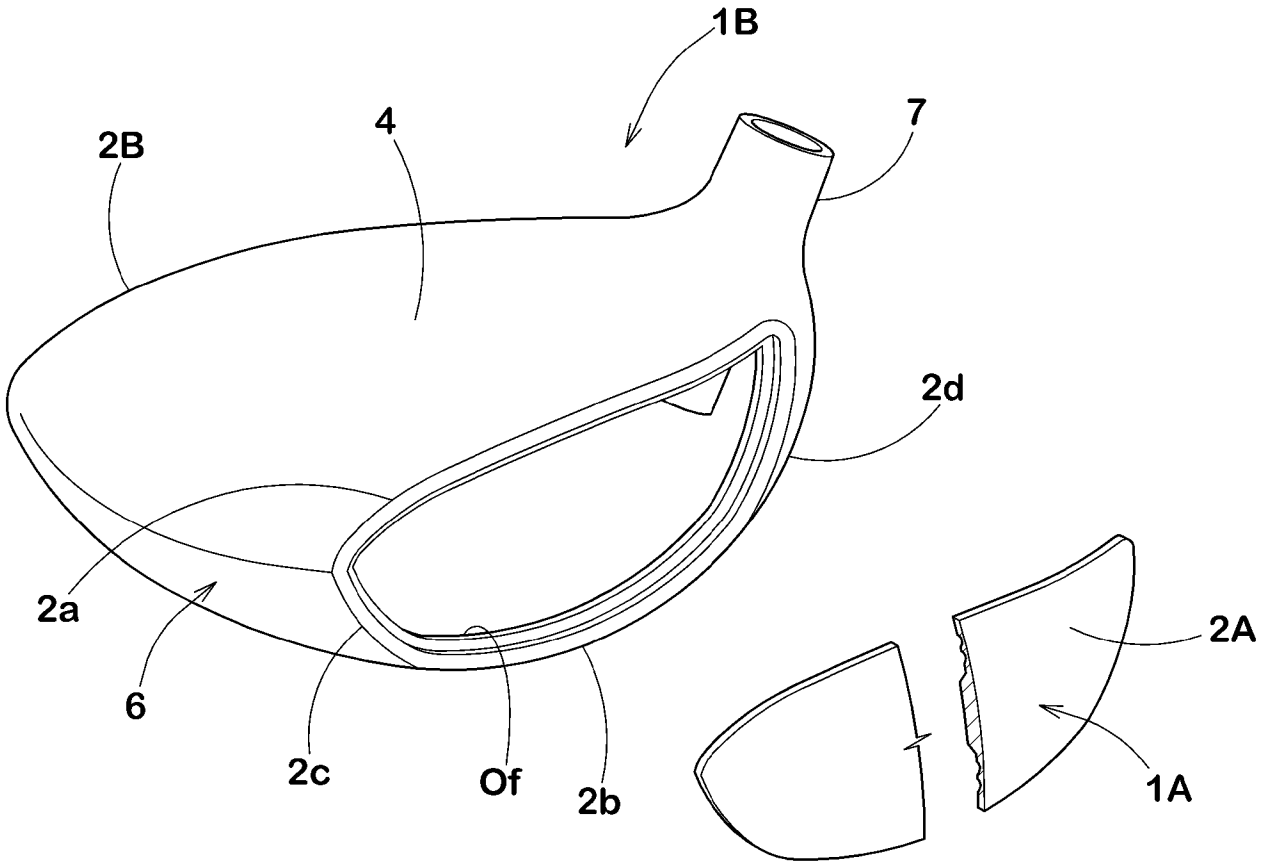
FIG. 8 is an exploded view of the club head showing the other embodiment of the present invention.
Figure 9:
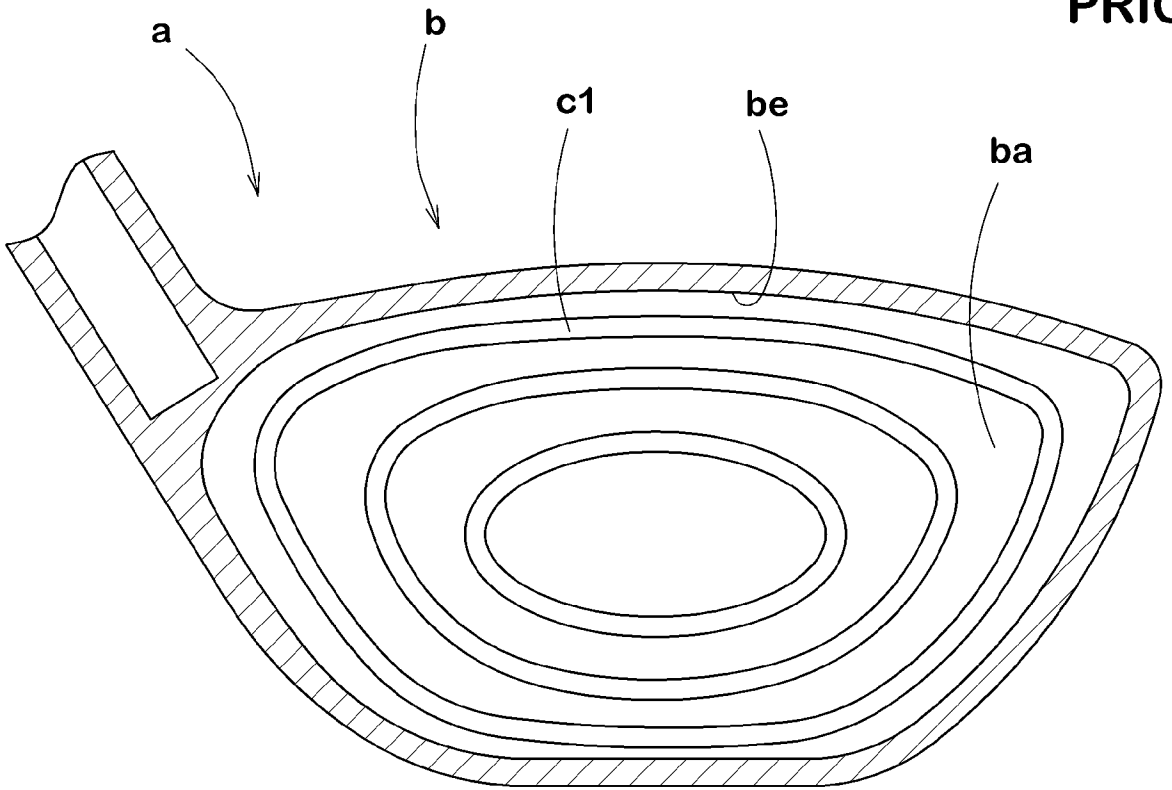
FIG. 9 is a rearview of a face portion of a conventional club head.

While preferable embodiments of the present invention have been described with reference to the drawings, it goes without saying that the present invention is not limited to only such embodiments and various changes and modifications may be made. As shown in FIG. 8, a plate-type shape which has a periphery being within the edges 2*a* to 2*d* of the clubface 2A may be employed as for the face member 1A, for example. The face member may be attached by welding onto an opening (of) of the head main body 1B. This plate-type face member 1A may be useful to improve the productivity of the golf club head 1, because first and second grooves G1 and G2 can be easily formed.

The present invention is more specifically described and explained by means of the following Examples and References. It is to be understood that the present invention is not limited to these Examples.

Comparison Test:

In order to confirm the effect of the present invention, wood-type golf club heads (#3: Spoon head) were manufactured according to the specifications shown in FIGS. 1 to 5 and Table 1, and tests of spring effect, productivity and durability of face were made. Specifications of golf club heads were common to all club heads except for parameters listed on Table 1. Major specifications of golf club heads were as follows.

Head volume: 165 $cm^3$
Head weight: 208 g
Loft angle of face: 15 degrees
Lie angle of face: 58 degrees
Face portion: Titanium alloy
Thickness of central thicker portion: 2.3 mm (constant)

The tests were made in the following manner.

Spring Effect Test:

"Characteristic time" (CT) of each club heads were measured based on the Pendulum Test Protocol defined in "Technical Description of the Pendulum Test" issued by USGA on Feb. 24, 2003. The CT value is a value (unit: μs) showing an efficiency at impact, and the larger the value, the higher the spring effect.

Productivity Test:

Manufacturing time to form grooves on inner surfaces of face members of each club heads were measured. The results were shown as indices that the reciprocal of the manufacturing time of Ref. 1 is 100. The larger the value shows the shorter the manufacturing time.

Durability Test:

A plurality of wood type golf clubs with a length of 43 inch were manufactured by attaching the same FRP shafts (Miyazaki Kusala FLEX S manufactured by SRI Sports Limited.) to each of the club heads, and 20000 times ball hitting tests were performed in all the clubs by using a swing robot. Then an amount of depression on the hitting face of each club head was measured. The hitting conditions and the like are as follows.

Head speed: 49 m/s

Hitting point of face: Sweet Spot

Golf ball: "Z-STAR" manufactured by SRI Sports Limited.

The results are shown in Table 1.

TABLE 1

| | Ref. 1 | Ref. 2 | Ex. 1 | Ex. 2 | Ex. 3 | Ex. 4 | Ex. 5 | Ex. 6 | Ex. 7 | Ex. 8 | Ex. 9 |
|---|---|---|---|---|---|---|---|---|---|---|---|
| Angle of First Grooves θ1 (deg.) | 90 | 45 | 90 | 75 | 80 | 85 | 90 | 90 | 90 | 90 | 90 |
| Angle of Second Grooves θ2 (deg.) | 90 | 45 | 0 | 0 | 0 | 0 | 10 | 5 | 0 | 0 | 0 |
| width w1 of First and Second Grooves (mm) | 0.8 | 0.8 | 0.8 | 0.8 | 0.8 | 0.8 | 0.8 | 0.8 | 0.08 | 0.1 | 0.3 |
| Depths D1 of First and second Grooves (mm) | 0.18 | 0.18 | 0.18 | 0.18 | 0.18 | 0.18 | 0.18 | 0.18 | 0.18 | 0.18 | 0.18 |
| Ratio P1/w1 | 1.3 | 1.3 | 1.3 | 1.3 | 1.3 | 1.3 | 1.3 | 1.3 | 1.3 | 1.3 | 1.3 |
| spring Effect (μs) | 160 | 165 | 210 | 185 | 190 | 195 | 192 | 200 | 201 | 204 | 206 |
| Productivity (Index) | 100 | 100 | 100 | 100 | 100 | 100 | 100 | 100 | 70 | 73 | 98 |
| Durability (Number of shots up to Damage) | 16,000 | 17,000 | 20,000 | 18,000 | 18,500 | 19,000 | 19,500 | 19,700 | 20,000 | 20,000 | 20,000 |

| | Ex. 10 | Ex. 11 | Ex. 12 | Ex. 13 | Ex. 14 | Ex. 15 | Ex. 16 | Ex. 17 | Ex. 18 | Ex. 19 | Ex. 20 |
|---|---|---|---|---|---|---|---|---|---|---|---|
| Angle of First Grooves θ1 (deg.) | 90 | 90 | 90 | 90 | 90 | 90 | 90 | 90 | 90 | 90 | 90 |
| Angle of Second Grooves θ2 (deg.) | 0 | 0 | 0 | 0 | 0 | 0 | 0 | 0 | 0 | 0 | 80 |
| width w1 of First and Second Grooves (mm) | 2 | 3 | 4 | 0.8 | 0.8 | 0.8 | 0.8 | 0.8 | 0.8 | 0.8 | 0.8 |
| Depths D1 of First and second Grooves (mm) | 0.18 | 0.18 | 0.18 | 0.01 | 0.02 | 0.06 | 0.5 | 0.75 | 1 | 2.2 | 0.18 |
| Ratio P1/w1 | 1.3 | 1.3 | 1.3 | 1.3 | 1.3 | 1.3 | 1.3 | 1.3 | 1.3 | 1.3 | 1.3 |
| spring Effect (μs) | 211 | 213 | 215 | 190 | 193 | 195 | 220 | 225 | 230 | 234 | 162 |
| Productivity (Index) | 97 | 95 | 92 | 115 | 113 | 110 | 85 | 82 | 78 | 70 | 100 |
| Durability (Number of shots up to Damage) | 20,000 | 20,000 | 20,000 | 20,000 | 20,000 | 20,000 | 18,000 | 17,000 | 16,000 | 15,500 | 16,100 |

| | Ex. 21 | Ex. 22 | Ex. 23 | Ref. 3 | Ex. 24 | Ex. 25 | Ex. 26 | Ex. 27 | Ex. 28 | Ex. 29 |
|---|---|---|---|---|---|---|---|---|---|---|
| Angle of First Grooves θ1 (deg.) | 90 | 90 | 90 | 0 | 90 | 90 | 90 | 85 | 90 | 90 |
| Angle of Second Grooves θ2 (deg.) | 60 | 40 | 20 | 0 | 0 | 0 | 0 | 0 | 0 | 0 |
| width w1 of First and Second Grooves (mm) | 0.8 | 0.8 | 0.8 | 0.8 | 0.8 | 0.8 | 0.8 | 0.8 | 0.8 | 0.8 |
| Depths D1 of First and second Grooves (mm) | 0.18 | 0.18 | 0.18 | 0.18 | 0.18 | 0.18 | 0.18 | 0.18 | 0.18 | 0.18 |
| Ratio P1/w1 | 1.3 | 1.3 | 1.3 | 1.3 | 0.9 | 1.1 | 1.4 | 1.1 | 1.5 | 1.6 |
| spring Effect (μs) | 168 | 180 | 190 | 160 | 215 | 212 | 190 | 210 | 185 | 180 |
| Productivity (Index) | 100 | 100 | 100 | 100 | 88 | 98 | 105 | 98 | 107 | 110 |
| Durability (Number of shots up to Damage) | 17,800 | 18,000 | 19,000 | 16,000 | 18,000 | 19,000 | 20,000 | 19,600 | 20,000 | 20,000 |

From the results shown in Table 1, it was confirmed that the golf club heads of the Examples according to the present invention can be improved spring effect and productivity in a well-balanced manner compared to References. Moreover, the same tests described above were made on Driver (#1), Baffy (#4) and Cleek heads (#5), the same results as Table 1 were confirmed.

The invention claimed is:

1. A golf club head having a hollow comprising a face portion whose front face defines a clubface for hitting a ball, the face portion comprising a central thicker portion provided in a center region thereof and a peripheral thinner portion provided around the central thicker portion and having a thickness smaller than that of the central thicker portion, the peripheral thinner portion having an inner surface facing the hollow, the inner surface of the peripheral thinner portion comprising a first region and a second region, the first region being provided with a plurality of first grooves which extend straightly in a certain direction, and the second region being provided with a plurality of second grooves which extend straightly in the different direction of first grooves.

2. The golf club head according to claim 1, wherein first grooves extend in parallel with each other.

3. The golf club head according to claim 1 or 2, wherein second grooves extend in parallel with each other.

4. The golf club head according to claim 1 or 2, wherein first grooves extend at right angles to second grooves.

5. The golf club head according to claim 1 or 2, wherein first grooves and second grooves each have a groove depth in a range of from 0.02 to 0.80 mm and a groove width in a range of from 0.1 to 3.0 mm.

6. The golf club head according to claim 1 or 2, wherein first grooves and second grooves each have an arc shape in a cross section intersecting with the longitudinal direction of each groove, and the arc shape has a radius of curvature of from 1.0 to 5.0 mm.

7. The golf club head according to claim 1 or 2, wherein pitches between adjacent first grooves are in a range of from 1.0 to 1.5 times groove widths of first grooves, and pitches between adjacent second grooves are in a range of from 1.0 to 1.5 times groove widths of second grooves.

8. The golf club head according to claim 1 or 2, wherein in a front view under a standard state that the club head is placed on a horizontal plane, so that a clubshaft center line inclines at its lie angle within a vertical plane, and the clubface inclines at its loft angle with respect to the vertical plane, first grooves incline at angle of from 80 to 100 degrees with respect to the horizontal plane, and second grooves incline at angle of from 0 to 10 degrees with respect to the horizontal plane.

9. The golf club head according to claim 8, wherein first grooves are provided with a toe side region and a heel side region of the inner surface of the peripheral thinner portion, and second grooves are provided with a crown side region and a sole side region of the inner surface of the peripheral thinner portion.

* * * * *